United States Patent [19]

Currey et al.

[11] Patent Number: 4,628,596

[45] Date of Patent: Dec. 16, 1986

[54] ELECTROLYTIC CELL WITH REDUCED INTER-ELECTRODE GAP

[76] Inventors: John E. Currey, 4720 Lower River Rd.; Colin S. McLarty, 419 Tryon Dr., both of Lewiston, N.Y. 14092; Donald H. Porter, 89 Meadow La., Tonawanda, N.Y. 14223

[21] Appl. No.: 755,307

[22] Filed: Dec. 29, 1976

[51] Int. Cl.[4] ..... H01R 43/00; C25B 11/02; C25B 13/08; B21D 22/02; B21D 22/00; H01B 13/00

[52] U.S. Cl. ..... 29/825; 204/288; 204/289; 204/290 R; 72/359; 29/624

[58] Field of Search ..... 204/252, 253, 259, 283, 204/289, 268, 286, 288, 290 R; 29/1.3, 592 R, 625, 624, 825; 72/359

[56] References Cited

U.S. PATENT DOCUMENTS

| | | | |
|---|---|---|---|
| 2,079,102 | 5/1937 | Biginelli | 29/1.3 |
| 3,215,609 | 11/1965 | Chapdelaine | 204/289 |
| 3,674,676 | 7/1972 | Fogelman | 204/252 X |
| 3,941,676 | 3/1976 | Macken | 204/252 X |
| 3,976,556 | 8/1976 | DeNora | 204/283 X |
| 3,981,790 | 9/1976 | Olson et al. | 204/286 |
| 4,051,008 | 9/1977 | Ford et al. | 204/288 X |

FOREIGN PATENT DOCUMENTS

| | | | |
|---|---|---|---|
| 429633 | 6/1935 | United Kingdom | 204/286 |

*Primary Examiner*—Donald R. Valentine
*Attorney, Agent, or Firm*—Kenyon & Kenyon

[57] ABSTRACT

Improved electrolytic cell performance is obtained by modifying a standard box anode by increasing the width thereof by permanently deforming the anode mesh within the immediate vicinity of the anode post. Increases in anode width of from about 3 mm to about 12 mm, resulting in reduction of interelectrode gap of about 1.5 mm to about 6 mm, have been found advantageous. Improvement is enhanced by the use of a polymer bonded asbestos diaphragm.

5 Claims, 4 Drawing Figures

ELECTROLYTIC CELL WITH REDUCED INTER-ELECTRODE GAP

BACKGROUND OF THE INVENTION

A commercially significant application of electrolysis is the production of halogens, particularly chlorine, and alkali metal hydroxides, particularly sodium hydroxide, by electrolysis of aqueous alkali metal halide solutions, particularly sodium chlorine solutions in electrolytic cells with diaphragms between the anode and cathode elements of such cells. Most cell designs contain three basic elements; namely, the anode, cathode, and diaphragm. The vehicle for both supporting the anodes within the cell compartment and conducting the electrolyzing current to the anode posts is the anode base. In some instances, the anodes may be supported from the top or sides of the cell rather than be extended from the bottom, and in such cases, the top or side becomes the "base" for the purposes described herein. Commonly, the anodes are arranged vertically in uniformly spaced rows covering the width of the anode base. The cathode generally rests upon the anode base but is electrically insulated therefrom, and the cathode elements serve to divide the cell into a series of anolyte and catholyte compartments. The cathode elements additionally serve to support the diaphragm, which can be a layer of asbestos fibers or asbestos fibers and additional materials, such diaphragm serving to separate the anolyte and catholyte compartments of the cell. In the conventional diaphragm cell a relatively wide gap is maintained between the anode and the cathode, with the diaphragm between the two. Modern cells employ a dimensionally stable foraminous metal anode, and the cathode is usually foraminous iron or steel. Each commercial cell contains a plurality of anode and cathode elements. The anode elements are fixed to the anode base and are spaced apart in a manner which permits cathode elements to be alternated between anode elements.

In the normal construction of such cells, the diaphragm is in direct contact with the cathode elements. Frequently, the diaphragm is deposited on the cathode by immersing the cathode in an aqueous slurry of asbestos, which may contain additional materials, and causing the slurry to flow through pores or mesh openings of the foraminous cathode until a porous sheet or layer of asbestos has been deposited on the sides of the cathode which when in use are opposite the anode.

When the diaphragm cell is used to produce chlorine, an alkali metal chloride solution is used as the cell electrolyte. As the current passes through the electrolyte between the anode and cathode, chlorine is evolved at the anode and alkali metal hydroxide is formed, with liberation of hydrogen, at the cathode. The porous diaphragm described above, located in the anode-cathode gap, prevents mixing of the hydrogen with chlorine and mixing of hydroxides with incoming brine and with the chlorine product.

In diaphragm cells, it is desired to keep the gap between anode and cathode small to minimize the resistance of the electrolyte in the gap to passage of electrolyzing current, and thereby reduce significantly the operating voltage of the cells and reduce energy consumption and increase power efficiency.

With conventional diaphragm cells, the gap between the anode and cathode cannot be reduced below a certain practical minimum distance, typically from about 9 to about 13 mm. Normally, a relatively wide separation between electrode elements must be specified in cell construction to allow for dimensional deviations or misalignments of the anodes and diaphragm-covered cathodes. Otherwise, such deviations or misalignments would cause scraping and injury to the diaphragm between the anode and cathode during assembly of the cell. Such scraping must be avoided to prevent breaking the diaphragm, which would cause operation problems due to mixing of the anodic and cathodic electrolysis products of electrical short-circuiting between anodes and cathodes. Further, cathodes, which are generally steel screens, and anodes, which are generally coated titanium mesh, become misshapen and distorted through use and with age. In addition, the diaphragm material is normally deposited by vacuum upon the surface of the cathode from a slurry, and the result is often a diaphragm of non-uniform thickness, which result is compounded by the fact that asbestos diaphragms often swell or expand during use. Normal anode and cathode heights are more than twelve inches, and often as much as thirty or more inches, making net displacements from the vertical approaching 13 mm or more at one or more mating sites a common result, as a practical matter. Therefore, when an attempt is made to place the cathode fingers, carrying the diaphragm thereon, over vertically-disposed anode blades, difficulties will be encountered unless such cells are specified with a designed anode-cathode gap greater than approximately 13 mm. Difficulties include destruction of diaphragms, and the like, as pointed out in U.S. Pat. No. 3,674,676 to Fogelman. Many of these difficulties can be minimized by use of a dimensionally stable, heat-fused, and polymer reinforced diaphragm, but even when this is done, it is desirable to minimize the anode to cathode gap.

A consideration which limits the narrowness of the inter-electrode gap is related to the passage of chlorine evolved at the anode and the replenishing of brine solution in contact with the anode. If the inter-electrode gap is too narrow in operation of the cell, cell performance can be affected adversely because of insufficient brine circulation, the formation of gas pockets, or development of hot spots. These problems are observed in operation of cells with inter-electrode gaps less than about 5 millimeters.

SUMMARY OF THE INVENTION

The present invention relates to the use of non-adjustable box-type anodes in electrolytic cells with a reduced gap. To achieve this gap reduction, a box-type anode of conventional construction is modified to increase the separation between the parallel anodic surfaces thereof, without significantly affecting the effective anodic surface area. This may be achieved by cutting the end panels of a single box-type anode its entire vertical length, and then, by means of an internal punch, pressing the electrolytic surfaces against an external fixed die, to bend the anode material, e.g. titanium mesh outwardly from the anode post, and at a complimentary angle a short distance therefrom. The resultant anode configuration has parallel anodic surfaces with a separation greater than the diameter of the anode post, except where joined to the post. The portions of the anode mesh laterally furthest removed from the anode post may be bent perpendicularly, toward each other, so as to maintain the greatest degree of anodic surface utilization, or at a suitable angle toward the centerline of the anode so as to make rejoining of the severed end panels of the anode convenient. Mechanical integrity of the anode surfaces with the anode post is maintained, and the cut end panels may be mechanically joined by welding or other means such as clips, to insure stability of the widened anode. Alternatively, the bending operation may be conducted without severing of the end panels.

DESCRIPTION OF DRAWINGS

Referring to the drawings, FIG. 1 illustrates a top view of a typical box anode, prior to modification. The anode is constructed of a valve metal surface 2 in sheet or foraminated form and is welded to an anode post or riser 1. Upon insertion into a cell, the anode riser conducts the electric current from its associated busbar, not shown, to the anode surface 2. The valve metal is normally coated on the exposed side with an anodic active material.

FIG. 2 illustrates a top view of a modified anode, as prepared by this invention, from the type shown in FIG. 1. The shape of the anode has been modified, the anode post 1 is attached in its original position, and the anode surface 2 has been deformed in the vicinity of the anode post.

FIG. 3 shows a sectional view of the deformation procedure, that is the positioning of the external die 4 with the anode inserted between and the punch 5 inserted into an open end of the anode deforming permanently the anode surface 2 adjacent to the anode post 1. In this example, the deformation of the anode material 2 has occurred by the insertion of the punch 5 into the open end of the box anode and deformation has occured at 3. Punch 5 can be inserted into the opening on the opposite side of the anode post 1 and that side of the anode will be deformed in accordance with die 4. For illustration purposes a single punch is shown, but multiple punch units may be employed.

FIG. 4 is a perspective drawing of an anode which has undergone expansion in accordance with the present invention.

Figure 1:
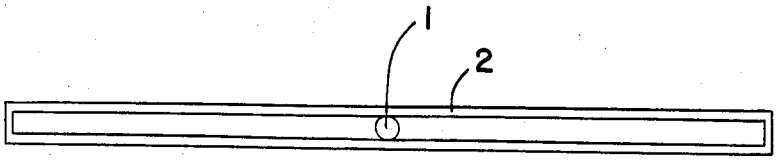
FIG. 1 shows a top view of a typical box anode.
Figure 2:
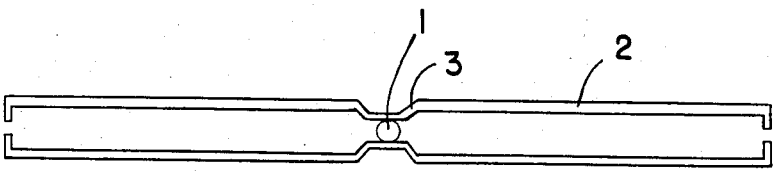
FIG. 2 shows a top view of the modified anode according to the present invention.
Figure 3:
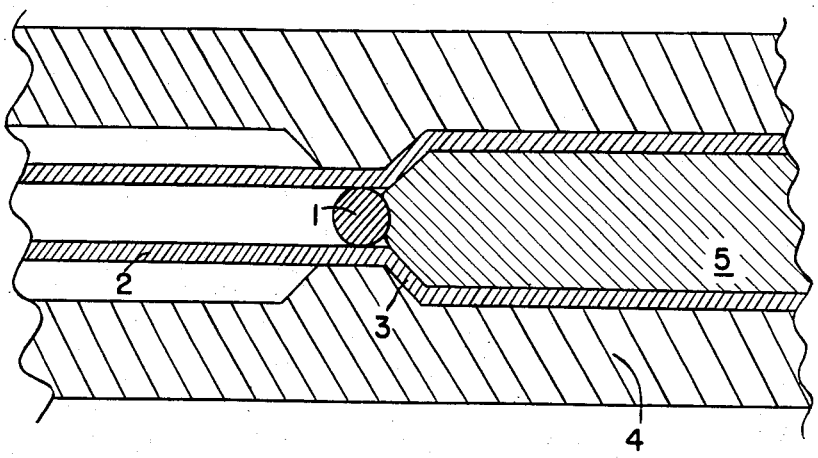
FIG. 3 shows a top sectional view of the anode being modified with the punch inside the anode and the external die.
Figure 4:
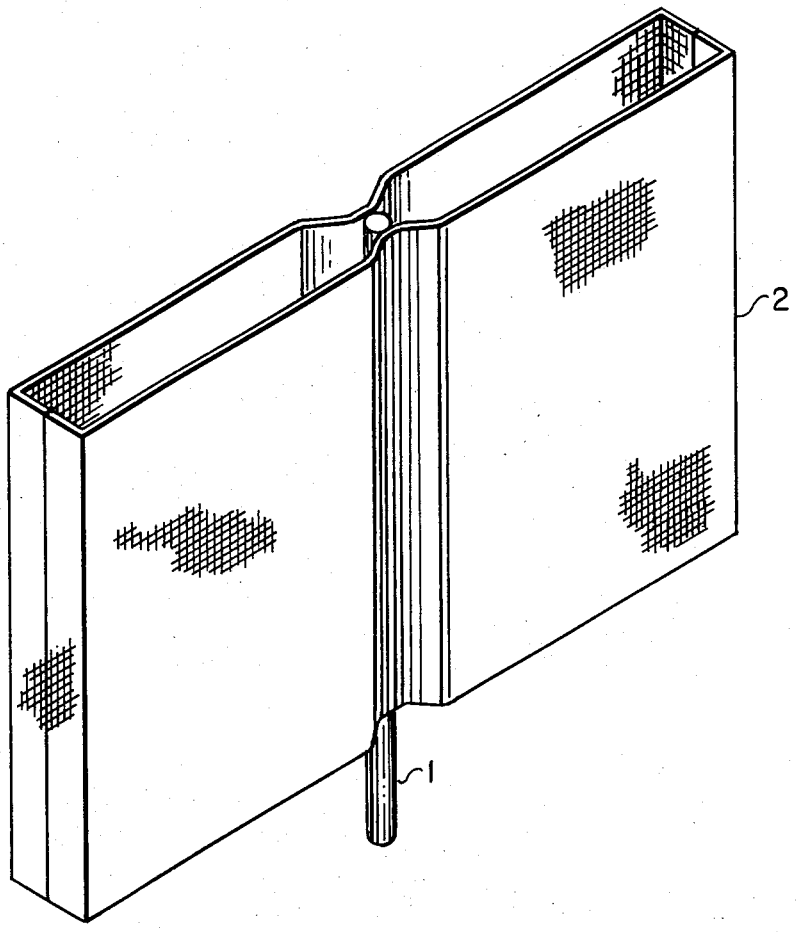
FIG. 4 shows a perspective view of an expanded anode according to the present invention.

An anode, widened thusly, gives a narrowed gap between electrodes while an existing anode base along with other cell elements is retained. Preferably, dimensionally stable metal anodes are modified, comprising generally an electrically conductive, electrocatalytically active coating, such as platinum or a noble metal oxide, on an electrically conductive substrate, which can be a valve metal, such as titanium. This invention has particular utility in the modification of existing diaphragm cells, so as to improve their efficiency. By this technique, a chlor-alkali producer may significantly improve operating characteristics of his cells, while avoiding the major expense associated with anode replacement. Since dimensionally stable anodes of conventional box configuration, as have been available for the past few years, have useful life spans significantly greater than those of other cell components, such as diaphragms, modification of the anode may profitably be done during a cell shutdown for diaphragm renewal or other routine repair.

To ease cell reassembly after anode modification, a guide spacer shaped approximately like a hairpin may be used, which spacer can extend over an anode element vertically downward from the anode top. The guide spacers comprise two parallel members joined at the upper end in a sloping configuration, which can be rounded, so as to form an inverted U, or pointed to form a ridge. Other configurations of guide spacer shapes are possible, subject to the requirement that the shape permit the guide spacer to function as a guide for assembly of the cell. The guide spacer can extend downward a portion of or the entire distance to the bottom of the anode. The sloping upper portions of the guide spacers serve the purpose of guiding the cathode elements into their proper position between anode elements as the cathode carrying the diaphragm is lowered over the anode elements during cell assembly. Preferably two or four guide spacers are positioned on each anode element. Loosely held guide spacers can later be removed before final installation of the cell top, leaving only the tightly held guide spacers in the cell. The utility of such a guide spacer is illustrated in U.S. patent application Ser. No. 726,312, filed Sept. 24, 1976, which is incorporated herein by reference.

Guide spacer materials of construction include substances which are hard, non-conductive and resistant chemically and physically to the cell environment. For example, chlorinated polyvinyl chloride has been used successfully for this purpose. Fluorine-containing polymers also are suitable for fabrication of guide spacers.

Although the present invention can be utilized with any diaphragm composition utilized in chlor-alkali cells of conventional construction, including diaphragms prepared from an aqueous slurry of asbestos, it is preferred that a hard, dimensionally stable, polymer bonded asbestos be used in the practice of the present invention. Such dimensionally stable diaphragms permit narrower inter-electrode gaps, since swelling or expansion of the diaphragm material during cell operation is less than that observed with diaphragms prepared from an aqueous asbestos slurry untreated with polymer bonding agents. The diaphragm must provide sufficient bearing strength to prevent substantial penetration of any guide spacer into the diaphragm during cell assembly. Unless such penetration can be avoided, destructive scraping of the diaphragm by the anode can result. An example of the suitable polymer bonded diaphragm is fluoropolymer bonded asbestos, known under the proprietary tradename HAPP Diaphragm, a trademark of Hooker Chemicals & Plastics Corp. Suitable polymers for use in such bonded asbestos diaphragm are polytetrafluoroethylene, polyvinyl fluoride, polyvinylidene fluoride, poly(chlorotrifluoroethylene-ethylene), poly(-tetrafluoroethylene-ethylene), polychlorotrifluoroethylene, and polyperfluoropropylene.

The advantages of a modified widened anode for use in an electrolytic cell are manifold.

Narrow gaps for use with cell elements in existing plants, even in the larger cells, are possible and advantageous when the present invention is utilized. No unusual care in pre-straightening and pre-aligning of anode elements prepared by the method of the present invention, and of cathode elements, is required to avoid scraping off of diaphragm material when polymer reinforced diaphragms are used. Such extraordinary care, if required, would constitute a difficult and time consuming operation which would increase the cost of assembly. Hardened diaphragms are disclosed in prior art cells which teach narrow inter-electrode gaps of less than 0.25 inch, such as described in U.S. Pat. Nos. 3,853,721 to Darlington et al., and 3,854,720 to Korach et al.

Since the present invention comprises a simple fixed anode, many advantages result from the present invention with respect to prior art attempts to narrow the inter-electrode gap by means of expandable anodes, such as those taught in U.S. Pat. No. 3,674,676 to Fogelman and U.S. Pat. No. 3,928,166 to O'Leary et al. or by adjustable anodes, such as those taught in U.S. Pat. No. 3,803,016 to Conner, Jr., or self-aligning anodes, such as are taught in U.S. Pat. No. 3,796,648 to Conner, Jr. et al.

Voltage savings due to gap reduction are fully realized, since there is no need for spring elements in the anode structure. Such spring elements would necessarily lengthen the current path and correspondingly add to the voltage drop, thus partially defeating the purpose of their use.

No impairment of anolyte circulation efficiency by added obstructions inside the anode boxes occurs. This means that current efficiency is not impaired. Such impairment in prior art apparatus can result from dual posts or large spring elements, and may be especially deleterious in narrow gap cells because narrow gap cells have a greatly reduced passage for circulation between the anode and diaphragm. All narrow gap cells consequently are more dependent upon a supply of strong anolyte through the anode mesh, rather than from flow through the inter-electrode gap. Thus, any obstructions within the anode box, such as are required by prior art apparatus, are particularly objectionable in narrow gap cells.

Additionally, by avoiding use of dual posts or anode spring elements, the present invention saves in consumption of anode metal. This represents the simplest construction, and therefore the most reliable and maintenance-free, as well as the least expensive manner of solving the problem of reducing the inter-electrode gap.

Assembly and disassembly of cells utilizing modified anodes of the present invention are simple, in that no multiple width adjustments or fastenings are required, as is the case with self-aligning anodes or adjustable anodes each time an adjustment is required.

The anodes of the present invention are less susceptible to deformation or other handling damage in routine plant use, in that the box-type anode construction of the present invention is considerably more rugged than prior art anodes of non-unitary construction, as typified by the adjustable anode and expandable anode apparatus of the prior art.

No elongated slots are necessary in the anode base, simplifying the design of seals required to prevent anolyte leakage, and further increasing the reliability of performance.

Since a significant portion of commercial installations in the US chlor-alkali industry use diaphragm cells with metal anodes having a relatively wide inter-electrode gap, the present invention gives a method to reduce the inter-electrode gap whereby existing anodes in such installations can be used to achieve the advantages set forth above, while avoiding the necessity for large capital investments in new anodes. Reduction of the anode-to-cathode gap, i.e. the interelectrode gap, may be significant utilizing this technique. For example, a typical box anode width (anodic surface to anodic surface) for existing diaphragm cells, is approximately 35 mm. A box anode prepared as set forth herein has a width of approximately 35 mm in proximity to the anode post, but is expanded throughout the major portion of its lateral and vertical dimension to 42 mm. This increase of 7 mm in width has the result of reducing anode to cathode gap by 3.5 mm. If the separation of the widened portion of the anode is increased to 46 mm, a net decrease in anode to cathode gap of 5.5 mm is realized. Since a typical anode to cathode gap for existing diaphragm cells is approximately 11 mm, it may be seen that the gap may be reduced to 7.5 mm using a 42 mm widened anode, or 5.5 mm, using a 46 mm widened anode. This latter gap approaches the limit of practicality, due to spacial requirements for chlorine evolution and brine replenishment. Expansion of the anode width from as little as about 3 mm up to about 12 mm is effective in improving electrical efficiencies, by yielding interelectrode gaps of from about 5 mm to about 9.5 mm.

EXAMPLE 1

Two Hooker cells, type H-4, 150,000 ampere chlor-alkali electrolytic test cells were assembled from conventional anode bases, conventional cathodes, hard, polymer-bonded, dimensionally stable, asbestos-base diaphragms bonded with 5% HALAR, and coated metal anodes expanded from the conventional width of 35 mm to 42 mm in thickness by pressing with a punch into a fixed die of the appropriate dimensions. The expanded anodes had been coated with an electrocatalytic coating containing ruthenium oxide, and after the expansion operation, the coating was not disturbed to any measurable extent, when investigated under magnification.

The average voltage observed is shown in the fourth column of Table 1, and voltage savings with respect to the control cells of Example 3, equipped with conventional width anodes and standard asbestos diaphragms, was 170 millivolts. Savings of 90 millivolts were observed with respect to the cells of Example 2, equipped with conventional width anodes and polymer bonded dimensionally stable diaphragms.

EXAMPLE 2

Two Hooker cells, types H-4, 150,000 ampere chlor-alkali electrolytic test cells were assembled as in Example 1, except that coated metal anodes of conventional width (35 mm) were installed. Averaged test results shown in Table 1 show voltage savings of 80 millivolts with respect to the control cells of Example 3, with standard diaphragms, but the observed voltage was 90 millivolts higher than with the expanded anode test cells of Example 1. This example illustrates the voltage savings resultant from the expanded anode, while also illustrating the additional advantage of the polymer bonded diaphragm.

EXAMPLE 3

Two Hooker cells type H-4, 150,000 ampere chlor-alkali electrolytic control cells were assembled as in Example 1, except that coated metal anodes of conventional width (35 mm), and standard asbestos diaphragms were installed. Test results are shown in Table 1.

EXAMPLE 4

Two Hooker cells, type H-4, 150,000 ampere chlor-alkali electrolytic cells were assembled as in Example 1, utilizing coated metal anodes expanded from 35 mm to 46 mm in thickness by vertical cutting of the anode end panel, pressing with a punch into a fixed die of the appropriate configuration, and spot welding support rods across the open ends of the end panel. Results comparable to those of Example 1 are obtained.

TABLE 1

Voltage Savings with Expanded Metal Anodes

| Example | Anode Width, mm | Diaphragm Type | Voltage Observed | Anode to Cathode Gap, mm | Voltage Savings, Millivolts |
|---|---|---|---|---|---|
| 1 | 42 | Polymer bonded | 3.44 volts | 7.5 | 170 |
| 2 | 35 | Polymer bonded | 3.53 volts | 11 | 80 |
| 3 (Control) | 35 | Standard Asbestos | 3.61 volts | 11 | — |

While the invention has been set forth and described with reference to particular specific details and preferred embodiments, it is clear that substitutions and modifications would be obvious to one of ordinary skill in the art, which would not depart from the scope of this invention as set forth by the appended claims.

We claim:

1. A method for fabricating an expanded anode wherein said anode is comprised of a pair of planar anode plates attached to an anode post, said pair of planar anode plates parallel to each other and separated by the diameter of the anode post, said method comprising expanding said anode by bending each plate, while attached to said anode post, to a position wherein the plates are substantially parallel to each other and the distance between said parallel portion of said plates is greater than the diameter of the anode post except where the plate is attached to said post.

2. The method of claim 1 wherein the anode plates are expanded by means of a punch and die.

3. The method of claim 1 wherein the anodic plates are expanded so as to be 3 to 12 mm. wider than their original width.

4. The method of claim 1 wherein opposite narrow end panels of the anode plates are joined together and cut vertically prior to expansion.

5. Method of claim 4 wherein the vertically cut anode plates are rejoined after being expanded.

* * * * *